United States Patent [19]

Roberts

[11] Patent Number: 4,835,910

[45] Date of Patent: Jun. 6, 1989

[54] HONING DEVICE

[75] Inventor: Timothy A. Roberts, Wabash, Ind.

[73] Assignee: TruAngle Broadhead Hones, Inc., Wabash, Ind.

[21] Appl. No.: 83,714

[22] Filed: Aug. 10, 1987

Related U.S. Application Data

[60] Division of Ser. No. 867,614, May 27, 1986, Pat. No. 4,696,129, which is a continuation of Ser. No. 613,896, May 24, 1984, abandoned.

[51] Int. Cl.[4] ..... B24D 15/06

[52] U.S. Cl. ..... 51/285; 51/327

[58] Field of Search ..... 51/285, 204, 205 R, 51/205 WG, 211 R, 211 H, 212–214, 181 R, 181 NT, 326–327, 391–392; 76/82, 86, 88; 29/80 A

[56] References Cited

U.S. PATENT DOCUMENTS

| | | | |
|---|---|---|---|
| D. 53,645 | 7/1919 | Taylor . | |
| D. 211,261 | 6/1968 | Theobald | 29/78 |
| D. 211,262 | 6/1968 | Theobald | 29/78 |
| D. 219,726 | 1/1971 | Van Horn | D8/2 |
| D. 260,356 | 8/1981 | Hall | D8/5 |
| 137,763 | 4/1873 | Daniels | 51/205 R |
| 555,819 | 3/1896 | Johnston | 51/181 |
| 1,540,078 | 6/1925 | Long | 51/204 |
| 1,803,364 | 5/1931 | Stephens | 51/211 H |
| 2,047,439 | 7/1936 | Skevington | 76/88 |
| 2,116,582 | 5/1938 | Muelberger, Jr. | 51/214 |
| 2,160,979 | 6/1939 | Moeller | 51/214 |
| 2,238,340 | 4/1941 | Poe | 51/181 |
| 2,798,344 | 8/1956 | Hertel | 51/211 |
| 3,623,280 | 11/1971 | Chesnut | 51/211 R |
| 3,733,933 | 5/1973 | Longbrake | 269/3 |
| 3,797,334 | 3/1974 | Sinclair | 76/88 |
| 3,819,170 | 6/1974 | Longbrake | 76/88 |
| 4,078,455 | 3/1978 | Brody | 76/88 |
| 4,228,703 | 10/1980 | Moss | 76/86 |

FOREIGN PATENT DOCUMENTS

| | | | |
|---|---|---|---|
| 0662781 | 12/1951 | United Kingdom | 51/213 |
| 2026909 | 7/1979 | United Kingdom . | |

*Primary Examiner*—Frederick R. Schmidt
*Assistant Examiner*—Robert A. Rose
*Attorney, Agent, or Firm*—Stephen T. Belsheim

[57] ABSTRACT

A honing device for simultaneously honing a plurality of commonly mounted discrete cutting elements such as multi-blade broadheads, treble fishhooks, and replaceable multi-blade broadheads. The honing device includes spaced-apart honing surfaces disposed relative to one another for simultaneously engaging and honing at a determined angle on each honing surface, a cutting edge of one of the commonly mounted discrete cutting elements. Interposed between an integral with adjacent edges of the spaced-apart honing surfaces is an accommodation for supporting the ferrule or common mounting device of the discrete cutting elements.

9 Claims, 2 Drawing Sheets

HONING DEVICE

CROSS REFERENCES COPENDING APPLICATIONS

This application is a divisional application of Ser. No. 867,614 filed May 27, 1984 now U.S. Pat. No. 4,696,129 which was a continuation of Ser. No. 613,896, filed May 24, 1984 now abandoned.

BACKGROUND OF THE INVENTION

This Invention relates generally to a honing device, and more particularly, to a honing device for simultaneously honing a plurality of discrete cutting elements secured to a common mount.

Bowhunters and fishermen require sharp broadhead blades and sharp fishhooks for use in the field. Once used, either for practice or in actual hunting or fishing, the cutting edges of such broadheads or fishhooks become dulled and less effective. Bowhunters or fisherman, therefore, must keep a large supply of sharp replacement blades or fishhooks with them in the field, or they must have a convenient method for sharpening these blades or fishhooks even in the field.

The multi-blade broadheads used in bowhunting as well as the treble fishhooks used by fisherman in deep water fishing, are relatively expensive and heretofore have been difficult to sharpen. In addition to actual use of such blades or fishhooks in hunting or fishing, other factors such as rust, storage in the bow quiver, storage in cabinets or tackle boxes also dull the edges of such blades or fishhooks, requiring sharpening before and after each use.

Conventional blade sharpener devices which have been provided generally comprise a component for securely holding a blade with at least one surface of its cutting edge available for engagement with the sharpening tool. Such devices work on a single blade surface and the blade must be released, inverted and reinserted in order to sharpen the opposite surface of the cutting edge.

There are sharpening devices which guide or hold a sharpener tool at a selected angle within a frame or with a frame and a template. Some of such frames have multiple slots or grooves for removably holding an abrasive surface and for inserting a blade angularly disposed relative to the abrasive surface for sharpening the cutting edge. Multiple grooves are often provided for the proper angle required for the opposite cutting surfaces of the blade's cutting edge.

Typically, the sharpening devices described above are awkward to manage and will engage only one surface of each cutting edge individually, and the blade must be repositioned to sharpen the opposite surface of the cutting edge. This is a cumbersome procedure not especially conducive to use in the field particularly when sharpening a multi-blade broadhead or treble fishhooks having a plurality of cutting edges extending radially outward at equally spaced intervals relative to one another from a common central mount.

One of the major problems involved with many of the available devices is obtaining an accurate angle to engage the blade with the sharpening tool. Often parts of the sharpening device will interfere with the required stroking motion of the sharpening tool on a portion of the blade. In addition, the unique feature of broadhead blades having a tapered configuration, pose special problems in an attempt to engage the entire cutting edge. These problems do not appear to be addressed, much less solved, by the aforementioned devices.

SUMMARY OF THE INVENTION

In one form of the invention there is provided a honing device for simultaneously engaging a plurality of discrete cutting elements secured on a common mount comprising a base having at least two spaced-apart honing surfaces disposed relative to one another so that each honing surface simultaneously engages at least one of the cutting elements so as to hone the cutting element.

In another form of the invention there is provided a honing device for simultaneously engaging a plurality of discrete cutting elements secured on a common mount comprising a base having at least two spaced-apart rounded honing surfaces disposed relative to one another so that each honing surface simultaneously engages at least one of the cutting elements so as to hone the cutting element.

In yet another form of the invention there is provided a honing device for simultaneously engaging a plurality of discrete broadhead blades each radiating outwardly at equally spaced intervals relative to one another from a common ferrule. The honing device comprises a base including a bottom surface and an upper portion integral with the base and including at least two spaced-apart honing surfaces, each having an adjacent edge. The spaced-apart honing surfaces are disposed relative to one another so that each of the spaced-apart honing surfaces engages at least one of the discrete broadhead blades so as to hone the engaged surface of the blades. The upper portion of this honing device includes a means, disposed between the adjacent edges of the spaced-apart honing surfaces, for accommodating the ferrule as each spaced-apart honing surface simultaneously engages and hones one of the discrete broadhead blades secured to the common ferrule.

It is an object of this invention to provide an improved honing device for simultaneously honing a plurality of cutting edges.

It is another object of this invention is to provide a convenient, portable honing device easy-to-use and easy-to-carry in the field.

Yet another object of this invention is to provide a portable honing device for simultaneously sharpening at least two discrete cutting elements commonly mounted on a common mounting device.

A further object of this invention is to provide a honing device which will enable even an inexperienced or unskilled person to simultaneously sharpen cutting elements at an accurate angle to obtain a razor edge.

Yet another object of this invention is to provide a honing device convenient to use in the field for simultaneously honing at least two blades of a multiblade broadhead or treble fishhooks without disassembling the blades from the arrow or removing the barbs from the fishhook.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF SPECIFIC EMBODIMENTS

Figure 1:
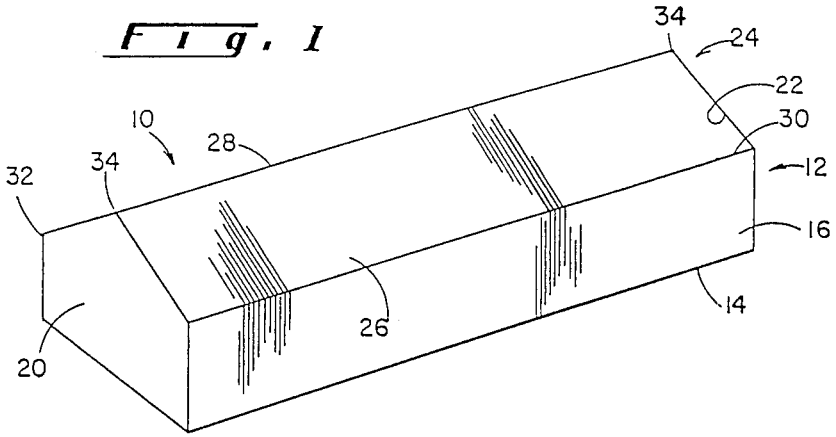
FIG. 1 is a perspective view of one embodiment of this invention for honing a solid multi-blade broadhead.
Figure 2:
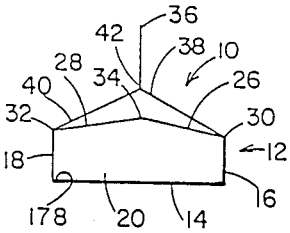
FIG. 2 is an end elevational view of the embodiment illustrated in FIG. 1 and engaging cutting edges of a solid three-blade broadhead.

Illustrated in FIGS. 1 and 2 is one embodiment of the invention herein generally designated as honing device 10. Honing device 10 includes base portion 12 having bottom surface 14, spaced-apart side walls 16, 18 (FIG. 2) and spaced-apart end walls 20, 22, only one is illustrated. Upper portion 24 includes a pair of spaced-apart honing surfaces 26, 28. Honing surfaces 26, 28 incline from opposite edges 30, 32, respectively, to extend upwardly and centrally to define vertex 34. FIG. 2 shows honing surfaces 26, 28 simultaneously engaging secured discrete blades 36, 38 while secured blade 40 extends upwardly from common mount 42.

Figure 3:
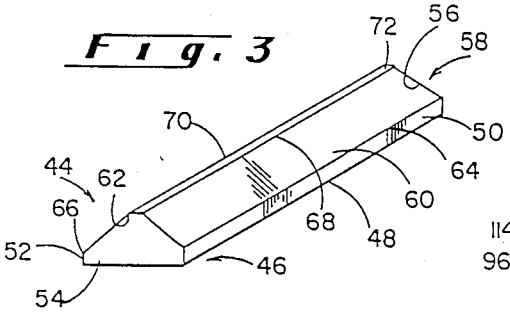
FIG. 3 is perspective view of another embodiment of this invention for honing a five-blade broadhead.
Figure 4:
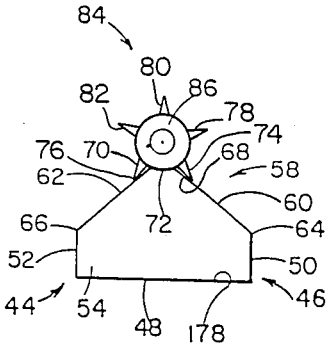
FIG. 4 is an end elevational view of the embodiment illustrated in FIG. 3 and engaging two cutting edges of a five-blade broadhead.

Referring now to FIGS. 3 and 4, it will be seen that another embodiment of the invention herein generally designated as honing device 44, accommodates five-blade broadheads. Honing device 44 comprises base portion 46 having bottom surface 48, side walls 50, 52 and end walls 54, 56, only one is illustrated. Honing device 44 has an upper portion 58 comprising spaced-apart honing surfaces 60, 62 extending from opposite edges 64, 66, respectively, to adjacent edges 68, 70, respectively. Ferrule support 72 can be a flat surface or a groove interposed between and integral with adjacent edges 68, 70.

In FIG. 4 honing surfaces 60, 62 are shown simultaneously engaging commonly mounted discrete blades 74, 76, respectively, while commonly mounted blades 78, 80, 82 of five-blade broadhead 84 extend radially outward from ferrule 86 and above ferrule support 72. Blades 74, 76, 78, 80, 82, are each discretely secured on and extend radially outward at equally spaced intervals relative to one another from ferrule 86. In a preferred embodiment of this invention, it has been found that an approximately 7/32" wide ferrule support 72 will more conveniently accommodate ferrule 86 for honing surfaces 60, 62 each to simultaneously engage a cutting surface of one of blades 74, 76, 78, 80, 82 at an accurate attitude to hone a sharp cutting edge.

Figure 5:
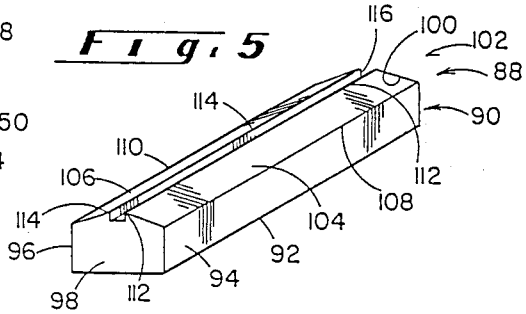
FIG. 5 is a perspective view of yet another embodiment of this invention for honing a replaceable multi-blade broadhead.
Figure 6:
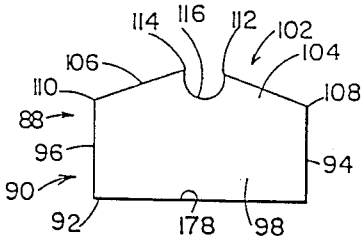
FIG. 6 is an end elevational view of the embodiment illustrated in FIG. 5 also including a hollow base.
Figure 7:
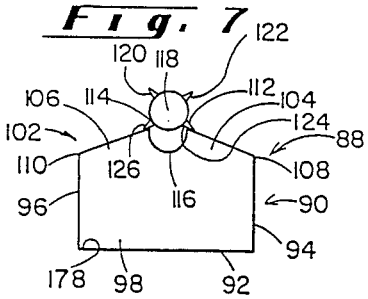
FIG. 7 is an end elevational view of the embodiment illustrated in FIG. 5 and simultaneously engaging two cutting edges of a replaceable four-blade broadhead.

Referring now to FIGS. 5, 6 and 7 which show honing device 88, an embodiment of this invention for simultaneously honing at least two blades of a replaceable multi-blade broadhead having either three or four discrete blades extending radially at equally spaced intervals relative to one another outward from a common ferrule. Honing device 88 includes base portion 90 with bottom 92, spaced-apart side walls 94, 96 and spaced-apart end walls 98, 100, only one is illustrated. Upper portion 102 includes spaced-apart honing surfaces 104, 106 inclining centrally from opposite edges 108, 110, respectively, to adjacent edges 112, 114, respectively. Groove 116 lies interposed between and abuts adjacent edges 112, 114.

As FIG. 7 illustrates, groove 116 is accommodating ferrule 118 of a replaceable four-blade broadhead. Each of discretely mounted blades 120, 122, 124, 126 radiate outward from ferrule 118 in an equal spaced-apart relationship from one another. Honing surfaces 104, 106 each simultaneously engages a cutting surface of blades 126, 124, respectively, when ferrule 118 rests in groove 116. Groove 116 is illustrated as having a squared configuration (FIG. 5) or rounded (FIGS. 6 and 7), however, groove 116 can be of any configuration which will accommodate ferrule 118.

Figure 9:
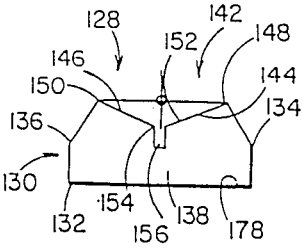
FIG. 9 is an end elevational view of the embodiment illustrated in FIG. 8.
Figure 8:
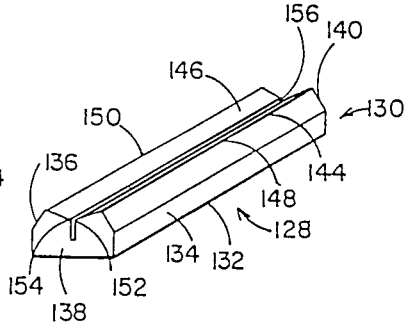
FIG. 8 is a perspective view of still another embodiment of this invention for honing a multi-blade broadhead.
Figure 10:
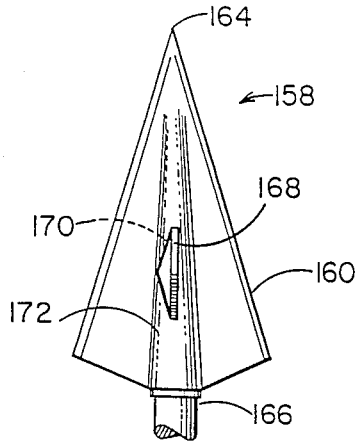
FIG. 10 is a perspective view of a solid two-blade broadhead.

FIGS. 8 and 9 show honing device 128 for simultaneously honing at least two discrete cutting surfaces of a two-blade or a four-blade broadhead. Typically, a solid two-blade broadhead 158 (FIG. 10) has a substantially triangular shape providing two main cutting blades 160, 162 on either side extending diagonally from the tip 164 to the base 166 of broadhead 158. There are then auxiliary or "bleeder" blades 168, 170, only one is illustrated, small blades radiating out substantially perpendicularly from central portion 172 of opposite faces 174, 176 of broadhead 158.

Honing device 128 comprises base portion 130 having bottom 132, spaced-apart side walls 134, 136 and spaced-apart end walls 138, 140. Upper portion 142 includes honing surfaces 144, 146 having inclining essentially centrally and downwardly from opposite edges 148, 150, respectively, to adjacent edges 152, 154, respectively. Groove 156 lies interposed between and is integral with adjacent edges 152, 154. Groove 156 is preferably narrow representing a center slot, but if widened to accommodate the broadhead's ferrule, it can then sharpen one of auxiliary or bleeder blade 168, 170 of broadhead 158. While the design of honing device 128 preferably accommodates solid broadhead blades, this design will hone certain replacement broadhead blades.

Figure 12:
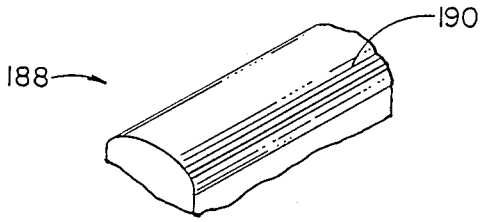
FIG. 12 is a fragmentary view of a rounded honing surface.

FIGS. 1, 3, 5 and 8 of honing devices 10, 44, 88 and 128 illustrate substantially planar honing surfaces. Some broadhead blades have concave edges causing the center part of the edge to curve away from a planar honing surface. In such broadheads, the front and back of the blade edge will touch the honing edges, however, the center of the blade does not touch a substantially planar honing surface. It is possible with the present invention to mount abrasive pads 188 (FIG. 12), only one is illustrated, having slight convex curve 190 from an adjacent edge to a respective opposite edge and extending between opposite end walls of any one of the embodiments illustrated in FIGS. 1, 3, 5 and 8.

Generally, new broadheads need extensive sharpening which would be very time consuming when using a honing surface. With the present invention, however, it is possible to removeably attach files to the honing surfaces of any one of the embodiments illustrated in FIGS. 1, 3, 5 and 8. Such files can cut down the new broadhead blades quickly and easily.

The inclined spaced-apart surfaces of the honing device act to guide and hold the engaged blades of a multiblade broadhead at the proper angle for honing. When the cutting edge properly engages one of the surfaces, the other surface will also be engaged by another cutting edge at a proper angle. When using a relatively expensive abrasive material, such as diamond abrasive, it is more economical to use the abrasive on only one of the inclined surfaces than on both. This is possible with applicant's honing device. Both surfaces, the abrasive and non-abrasive, act to guide and hold the engaged cutting edge at a proper angle relative to the abrasive surface.

Figure 11:
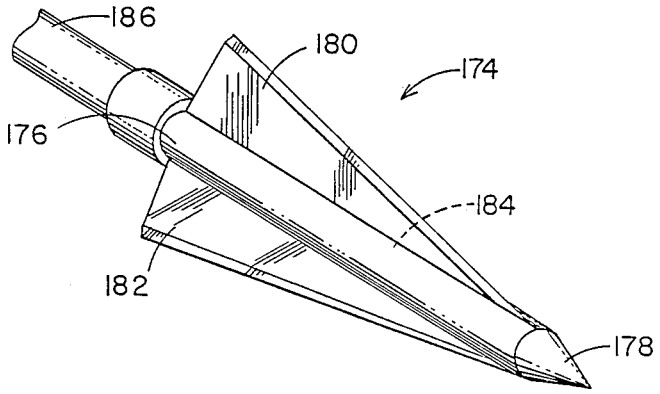
FIG. 11 is a perspective view of a replaceable three-blade broadhead.

FIG. 11 illustrates replaceable three-blade broadhead 174 including ferrule 176 extending to tip 178. Replaceable blades 180, 182, 184, only two are illustrated, extend radially outward at equally spaced intervals relative to one another from ferrule 176. The front tip of each of replaceable blades 180, 182, 184 locks under tip 178 at the forward point of ferrule 176. Tip 178 rides in groove 116 and back portion 186 of ferrule 176 rides outside groove 116 as spaced-apart honing surfaces 104, 106 each engage a cutting surface of one of replaceable blades 180, 182, 184.

Given in the following are specifications of a typical working embodiment of this invention. These are exemplary only and not limitative of the invention. The scope of the invention is given in the appended claims. The sharpening angle for the cutting edge surfaces can range from 2° to 35° on a surface. The angle defined between the honing surfaces of the embodiments illustrated in FIGS. 1, 3, 5 and 8, therefore, can range from 4° to 70° inclusive in order that said honing device will simultaneously engage the surface of cutting edges of two discrete blades, one on each honing surface. The optimum range, however for the angle disposed between the spaced-apart honing surfaces has been found to be between 20° to 48° inclusive.

In the honing devices illustrated in FIGS. 1 and 5, to accommodate a three-blade broadhead having three discrete blades radiating 120° from a common ferrule, the optimum range for the angle defined by the spaced-apart honing surfaces will be from 140° to 168° inclusive. In honing devices 10, 88, and 128 (FIGS. 1, 5 and 8), four-blade broadheads having four discrete blades radiating from a common ferrule at 90°, the angle range defined by the spaced-apart honing surfaces will be preferably from 110° to 138° inclusive.

In honing device 44 illustrated in FIG. 3, for a five-blade broadhead having five discrete blades radiating out from a common ferrule at 72°, the preferred angle range defined by the spaced-apart honing surfaces will be from 92° to 120° inclusive. Ferrule support 72 of honing device 44 can be a flat surface (FIGS. 3 and 4) or it can include a small groove interposed between adjacent edges 68, 70. In a preferred embodiment of this invention, it has been found advantageous to have the width of ferrule support 72 approximately 7/32of an inch.

Honing devices 10, 44, 88 and 128 can be extruded solid abrasive porcelain or formed of solid wood, metal or plastic having an abrasive covering or having pads of abrasive material such as tungsten carbide fitted to cover the spaced-apart honing surfaces. Honing devices 10, 44, 88 and 128 can also include a hollow structure providing compartment 178 within its base for storing such things as files, curved honing pads, or spare replaceable blades.

While there have been described above the principles of this invention in connection with specific devices, it is to be clearly understood that this description is made only by way of example and not as a limitation to the scope of the invention.

What is claimed is:

1. A method of honing a game-cutting head of a game-penetrating instrument using a honing device, comprising the steps of:

positioning adjacent to said honing device at least two of a plurality of discrete blades of said game-cutting head, said blades being spaced circumferentially about and radiating outwardly from a common ferrule of said game-penetrating instrument;

placing in simultaneous engagement with each of at least two separate inclined honing surfaces on said honing device a cutting edge on each of said at least two of said plurality of discrete blades, said each cutting edge being tapered transversely relative to its said respective blade and longitudinally relative to said common ferrule of said game-penetrating instrument; and moving longitudinally along said honing device said common ferrule of said game-penetrating instrument so as to maintain said cutting edges of said at least two discrete blades in engagement with said respective at least two honing surfaces of said honing device to simultaneously hone said longitudinally and transversely tapered cutting edges.

2. The honing method of claim 1, wherein said step of positioning said at least two of said blades of said game-cutting head of said game-penetrating instrument adjacent to said honing device is performed by holding said game-penetrating instrument at said common ferrule thereof.

3. The honing method of claim 1, wherein said step of placing said cutting edges of said discrete blades in simultaneous engagement with said honing surfaces on said honing device is performed by holding said game-penetrating instrument at said common ferrule thereof.

4. The honing method of claim 1, wherein said step of moving said common ferrule longitudinally along said honing device is performed by honing said game-penetrating instrument at said common ferrule thereof.

5. The honing method of claim 1, further comprising the step of supporting said common ferrule of said game-penetrating instrument on said honing device between said at least two honing surfaces thereof as said common ferrule is moved longitudinally along said honing device.

6. The honing method of claim 1, further comprising the step of accomodating said common ferrule of said game-penetrating instrument within said honing device between said at least two honing surfaces thereof as said common ferrule is moved longitudinally along said honing device.

7. A method of honing a game-cutting head of a game-penetrating instrument using a portable honing device, comprising the steps of:

positioning adjacent to said honing device at least two of a plurality of discrete blades of said game-cutting head, said blades being spaced circumferentially about and radiating outwardly from a common ferrule of said game-penetrating instrument;

placing in simultaneous engagement with each of at least two separate inclined honing surfaces on said honing device a cutting edge on each of said at least two of said plurality of discrete blades, said cutting edge being tapered transversely relative to its said respective blade and longitudinally relative to said common ferrule of said game-penetrating instrument;

moving longitudinally along said honing device said common ferrule of said game-penetrating instrument so as to maintain said cutting edges of said at least two discrete blades in engagement with said respective at least two honing surfaces of said honing device to simultaneously hone said transversely and longitudinally tapered cutting edges; and holding said game-penetrating instrument at said common ferrule thereof while performing said positioning, placing and moving steps.

8. The honing method of claim 7, further comprising the step of supporting said common ferrule of said game-penetrating instrument on said honing device between said at least two honing surfaces thereof as said common ferrule is moved longitudinally along said honing device.

9. The honing method of claim 7, further comprising the step of accomodating said common ferrule of said game-penetrating instrument within said honing device between said at least two honing surfaces thereof as said common ferrule is moved longitudinally along said honing device.

* * * * *